US005540294A

United States Patent [19]

Anderberg

[11] Patent Number: 5,540,294

[45] Date of Patent: Jul. 30, 1996

[54] VERTICAL PERCUSSION GROUND BORING TOOL APPARATUS AND METHOD

[75] Inventor: Thomas A. Anderberg, Oakland, Calif.

[73] Assignee: Anderberg Construction Company, Oakland, Calif.

[21] Appl. No.: 388,445

[22] Filed: Feb. 14, 1995

[51] Int. Cl.[6] ..... E21B 7/26

[52] U.S. Cl. ..... 175/19; 175/171; 175/414; 173/34

[58] Field of Search ..... 175/19, 414, 22, 175/23, 171; 173/34, 91

[56] References Cited

U.S. PATENT DOCUMENTS

| | | | |
|---|---|---|---|
| 3,242,999 | 3/1966 | Garner | 175/19 |
| 3,309,877 | 3/1967 | Degen | 175/19 |
| 3,410,354 | 11/1968 | Sudnishnikov et al. . | |
| 3,616,865 | 11/1971 | Sudnishnikov et al. | 173/125 |
| 3,651,874 | 3/1972 | Sudnishnikov et al. | 173/91 |
| 3,705,633 | 12/1972 | Sudinishnikov et al. | 173/91 |
| 3,727,701 | 4/1973 | Sudnishnikov et al. | 173/91 |
| 3,744,576 | 7/1973 | Sudnishnikov et al. | 173/91 |
| 3,756,328 | 9/1973 | Sudnishnikov et al. | 173/91 |
| 3,763,939 | 10/1973 | Sudnishnikov et al. | 173/91 |
| 3,902,322 | 9/1975 | Watanabe | 175/171 X |
| 3,942,595 | 3/1976 | Sudnishnikov et al. | 175/99 |
| 3,995,702 | 12/1976 | Klimashko et al. | 173/91 |
| 4,078,619 | 3/1978 | Sudnishnikov et al. | 175/19 |
| 4,121,672 | 10/1978 | Tkach et al. | 175/19 |
| 4,132,277 | 1/1979 | Tupitsyn et al. | 175/19 |
| 4,171,727 | 10/1979 | Tkach et al. | 175/19 |
| 4,221,157 | 9/1980 | Schmidt | 91/416 |
| 4,284,147 | 8/1981 | Jenne | 173/91 |
| 4,297,055 | 10/1981 | Peacock | 175/22 X |
| 4,548,526 | 10/1985 | Bullivant | 405/233 |
| 4,605,339 | 8/1986 | Bullivant | 405/237 |
| 4,609,052 | 9/1986 | Lewin | 173/91 |
| 4,648,746 | 3/1987 | Abinett | 173/91 X |
| 4,662,457 | 5/1987 | Bouplon | 173/91 |
| 4,732,222 | 3/1988 | Schmidt | 175/22 |
| 5,025,868 | 6/1991 | Wentworth et al. | 173/91 |
| 5,145,291 | 9/1992 | Bullivant | 405/230 |
| 5,163,520 | 11/1992 | Gibson et al. | 175/19 |
| 5,311,950 | 5/1994 | Spektor | 175/19 |

FOREIGN PATENT DOCUMENTS

| | | |
|---|---|---|
| 2048999 | 5/1979 | United Kingdom . |
| 2055932 | 7/1980 | United Kingdom . |
| 2092212 | 12/1980 | United Kingdom . |

OTHER PUBLICATIONS

Vermeer Manufacturing Company Brochure for Hammerhead Mole Pneumatic Boring Tool, dated Jun. 1992.

TT Technologies, Inc., Brochure for Grundomat Boring Tool, dated Feb. 1994.

*Primary Examiner*—Frank Tsay

*Attorney, Agent, or Firm*—Flehr, Hohbach, Test, Albritton & Herbert

[57] ABSTRACT

A self-propelled percussion boring tool apparatus (10) and method for incrementally boring a generally vertical hole (12) to substantial depths. The boring tool (10) includes a torpedo-shaped elongated cylindrical casing (13) having a trailing pipe (22) coupled to and extending away from the back end (14) of the casing (13). In another instance, the boring tool (10) includes a trailing pipe (34) extending away from the back end (14) of the casing (13), and formed to be retained in the hole (12) after removal of the boring tool (10). In either arrangement, the present invention facilitates recovery of the boring tool (10) from bored vertical holes (12) of substantial depth.

11 Claims, 3 Drawing Sheets

VERTICAL PERCUSSION GROUND BORING TOOL APPARATUS AND METHOD

TECHNICAL FIELD

The present invention relates, generally, to percussion ground boring tools, and, more particularly, relates to self-propelled ground piercing tools for boring generally vertical holes.

BACKGROUND ART

It is well known to employ self-propelled percussion tools for making small diameter horizontal holes through soil. Typically, these pneumatic, impact or percussion boring tools are used to displace soil in order to create horizontal holes beneath roadways to lay pipes or cables without having to dig a trench across the roadway.

These pneumatic boring tools generally include a torpedo-shaped body or casing having a tapered front nose portion and a hammer piston or striker disposed in a cavity provided in the casing for reciprocal movement therein. The hammer impacts against a front wall (front anvil) forming a portion of the cavity of the tool casing, causing the tool to move incrementally forward into the soil. The friction between the outside of the tool body and the surrounding soil tends to hold the tool in place as the striker reciprocates in the cavity for another impact against the front wall.

Generally, these percussion burrowing tools include an air hose extending from the tail assembly to provide pressurized air for pneumatic operation of the striker. During each piston cycle, air is typically exhausted from a rear opening at the tail assembly into the hole created by the boring tool. The valve mechanism inside the tool permits the pressurized air in the hose to be directed to drive the striker in a forward direction (i.e., to strike the front anvil), and also for driving the striker in a reverse direction (i.e., to strike a rear wall or rear anvil of the cavity). During each complete stroke of the piston hammer, there is a force stroke wherein pressurized air moves the piston against the front or rear anvil, and a return stroke wherein pressurized air returns the piston to an initial position. Typical of these patented pneumatic ground piercing tools are disclosed in U.S. Pat. Nos. 3,410,354; 3,756,328; 4,078,619; 4,221,157; 4,609,052; 4,662,457; and 5,025,868.

Reversing the direction of the hammer piston or striker to reverse the direction of incremental movement of the boring tool for recovery can be accomplished employing a number of different mechanisms and methods. Generally, however, in each device, the compressed air is communicated between an internal control sleeve or valve and the reciprocating hammer at two different locations within the device to cause the striker to impact either the front anvil or the rear anvil. Typical of these patented structures are disclosed in U.S. Pat. Nos. 3,616,865; 3,651,874; 3,705,633; 3,727,701; 3,744,576; 3,756,328; 3,763,939; 3,995,702; 4,078,619; 4,121,672; 4,132,277; 4,171,727; 4,284,147 and 4,662,457.

While reversing the direction of the striker has been adequate to recover these boring tools out of generally horizontal holes, the application of this technique to recover the tool from near vertical holes is not nearly as effective.

Soil conditions sometimes arise where the soil begins to collapse and fall into the vertical shaft atop the tail assembly of the tool. As the soil collapses atop the tail assembly, the boring tool, in the reverse direction, begins to compact the soil from below and is unable to push its way upwardly.

Hence, the recovery of these boring tools situated in vertically deeper holes, sometimes several times deeper than the length of the tools, is increasingly difficult. Further, the tools own weight in addition to the weight of the collapsed soil, and the generally blunt rear end of the casing, reduce the efficiency and effectiveness necessary to recover the tool.

Moreover, as the collapsed soil builds up atop the rear of the boring tool, the air exhausted from the rear of the tail assembly may be impeded. This causes blockage of the air flow which, as a result, reduces the power output of the tool. Ultimately, the reversing process may stop, leaving the boring tool wedged under the collapsed soil and unrecoverable under its own power. In this situation, it may be necessary to dig the boring tool out of the hole which is a time consuming and costly process or abandon the tool.

Typically, only the air hose extends rearwardly from the end of the boring tool. Pulling the boring tool by the air hose, in addition to overcoming the frictional forces of the wall and the weight of the collapsed soil, would most probably sever the hose.

One technique applicable towards the recovery of the vertical boring tool is that provided by the GRUNDOMAT® vertical bore machine which employs a percussion tool having a plurality of segmented steel pipes attached to the back of the tool. Each segment is added to the end of the last segment as the pipe descends below the ground into the hole. The steel pipe segments have a diameter substantially the same as the tool casing which further prevents caving of the vertical hole walls.

Problems occur, however, when attempting to recover the boring tool from deeper holes. The combined weight of the tool and segmented pipes, and more importantly, the frictional drag caused by the engagement of the perimeter walls of the pipe with the vertical hole walls substantially reduce the effectiveness of self-propelled recovery.

Accordingly, the GRUNDOMAT® vertical bore machine often requires the employment of a tall crane or hoist assembly vertically positioned over hole. This crane is formed to grip the end of the pipe to pull the boring tool apparatus out of the hole by mainly overcoming the frictional drag between the segmented pipe and the vertical hole walls. Not only is this procedure time consuming and costly to operate, however, some applications are limited or precluded where the vertical spacing above the hole is inadequate to install the crane or hoist assembly.

Another approach generally applied in softer soils has been to place a substantial portion of the boring tool inside a nose cone which is bored (pushed) into the ground as the boring tool pounds against the inner front walls of the nose cone. Subsequent sections of pipe are then attached to the rear of the front nose cone section. The nose cone and segmented pipe are then retained in the vertical hole, while the boring tool is pulled up and out of the nose cone and segmented pipe.

This technique is not capable of boring into harder or more compacted soil since the boring tool looses substantial efficiency inside the cone as some of the power is absorbed in the cone itself. Normally, the boring tool relies on the skin friction between the ground and the casing exterior surface to "push" off of the soil to further drive the boring tool into the ground. Since the boring tool is only loosely disposed in the nose cone, the boring tool has nothing to frictionally abut or push-off against.

DISCLOSURE OF INVENTION

Accordingly, it is an object of the present invention to provide a percussion boring tool apparatus and method for boring near vertical holes in the ground to a depth several times deeper than the length of the boring tool.

It is another object of the present invention to provide a percussion boring tool apparatus and method which reduces soil collapse as the tool bores further into the ground.

Another object of the present invention is to provide a percussion boring tool apparatus and method which facilitates recovery of the tool from deep vertical holes.

Yet another object of the present invention is to provide a percussion boring tool apparatus and method which is not limited by the vertical spacing or headroom above the bored hole.

Still another object of the present invention is to provide a percussion boring tool apparatus and method which shields the tool exhaust port from blockage due to caving of the soil.

Another object of the present invention is to provide a percussion boring tool apparatus and method which can place and position a "punch pile" in the ground, while enabling recovery of the boring tool.

It is a further object of the present invention to provide a percussion boring tool apparatus and method which is durable, compact, easy to maintain, has a minimum number of components, and is easy to use by relatively unskilled personnel.

In accordance with the foregoing objects, the present invention provides a self-propelled percussion boring tool for incrementally piercing soil through soil displacement to form generally vertical holes. The boring tool includes a torpedo-shaped elongated casing having a generally uniform transverse cross-sectional dimension extending from a back end to a front end thereof. The front end terminates at a nose portion which is formed for piercing the soil. A reciprocating hammer member is enclosed in the casing and is formed for reciprocating movement along a longitudinal axis of the casing. A control line is communicably coupled to the hammer and extends away from the back end of the casing. Further, the present invention includes a trailing pipe member coupled to or placed behind the casing and extending away from the back end of the casing in co-axial alignment with the casing longitudinal axis. The trailing pipe is of a length sufficient for grasping of an end thereof from the ground surface and formed for and receiving the line therein. The trailing pipe has a transverse cross-sectional dimension smaller than the transverse cross-sectional dimension of the casing such that continuous frictional contact with the vertical walls of the hole, above the casing, is avoided. Further, the transverse cross-sectional dimension of the trailing pipe must be sufficiently large to substantially prevent soil collapse from vertical walls of the hole to a position atop a substantial area of the casing.

In another aspect of the present invention, the self-propelled percussion boring tool includes a torpedo-shaped elongated casing having an exterior surface defining a generally uniform transverse cross-sectional dimension extending from a back end to a front end thereof. The casing defines a frontwardly facing annular shoulder portion extending radially outward from the exterior surface proximate the casing back end. The reciprocating hammer member is enclosed in the casing and is formed for reciprocating movement in a direction along a longitudinal axis of the casing. An annular ring member provides an opening formed and dimensioned for sliding receipt of the casing exterior surface therethrough until the ring member supportably seats against the casing shoulder portion. An elongated trailing pipe member is co-axially aligned with the casing and is fixedly mounted to the ring member in a orientation extending away from the casing back end. The trailing pipe defines a passageway therethrough sufficient in width for unencumbered receipt of the exterior surface and the annular shoulder portion therein. The ring member cooperates with the shoulder portion to urge the trailing pipe into the vertical hole upon incremental movement of the boring tool in a forward direction along the axis into the soil. Further, upon the shoulder portion withdrawing from seated contact with the ring member during incremental movement of the boring tool in a rearward direction, the boring tool exterior surface moves out of sliding receipt with the ring member opening. This enables removal of the boring tool through the pipe passageway so that the trailing pipe can be retained in the hole.

In still another aspect of the present invention, the self-propelled percussion boring tool includes an elongated anti-vacuum air tube extending longitudinally along the casing from proximate the front end to the back end thereof. The air tube provides air communication between a cavity at the front end of the casing and the back end of the casing. The cavity is formed between the casing nose portion and the compacted soil caused by the nose portion as the boring tool backed out of the hole.

A method of the present invention for boring a generally vertical hole in soil employing a pneumatic, self-propelled boring tool. Briefly, the method comprises the steps of: (a) selectively driving the hammer causing incremental movement of the boring tool into substantially compacted soil in direct contact with the tool outer casing, at an angle in the range of about 0° to about 45° from a vertical axis, to bore a hole defined by compressed walls of the soil; and (b) carrying a trailing pipe member behind the casing into the hole. The trailing pipe is coupled to or placed behind the casing and extends away from the back end thereof in co-axial alignment with the longitudinal axis. The trailing pipe has a transverse cross-sectional dimension smaller than the transverse cross-sectional dimension of the casing such that continuous frictional contact with the vertical walls of the hole, above the casing, is avoided. Further, the transverse cross-sectional dimension of the pipe member must be sufficiently large to substantially prevent soil collapse from vertical walls of the hole to a position atop a substantial area of the casing.

BRIEF DESCRIPTION OF THE DRAWING

The assembly of the present invention has other objects and features of advantage which will be more readily apparent from the following description of the best mode of carrying out the invention and the appended claims, when taken in conjunction with the accompanying drawing, in which:

BEST MODE OF CARRYING OUT THE INVENTION

Figure 1:
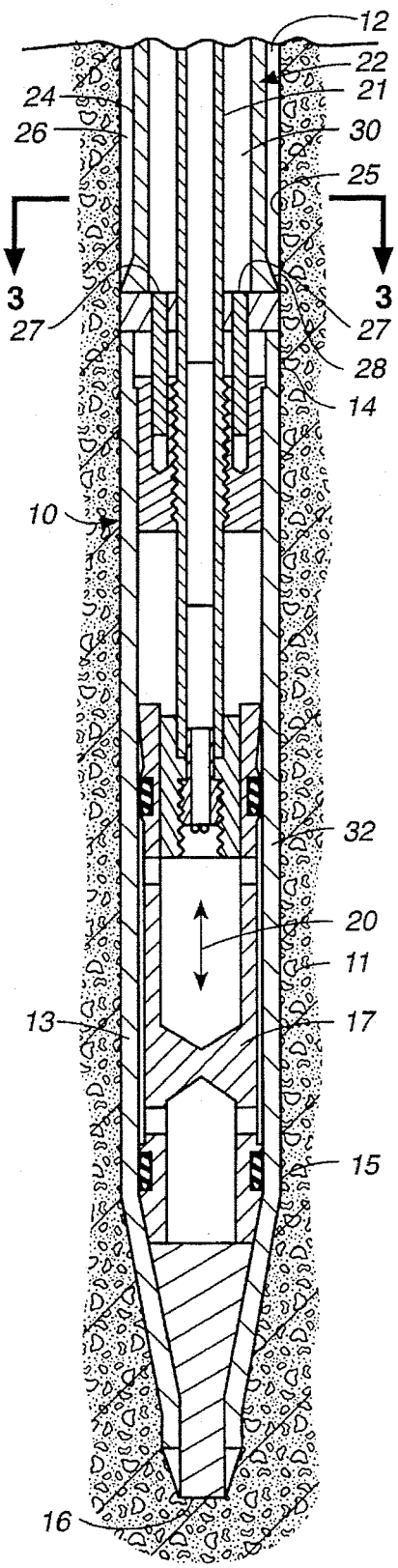
FIG. 1 is a fragmentary, side elevation view, in cross-section, of a percussion ground boring tool apparatus coupled to a trailing pipe member constructed in accordance with the present invention.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 2:
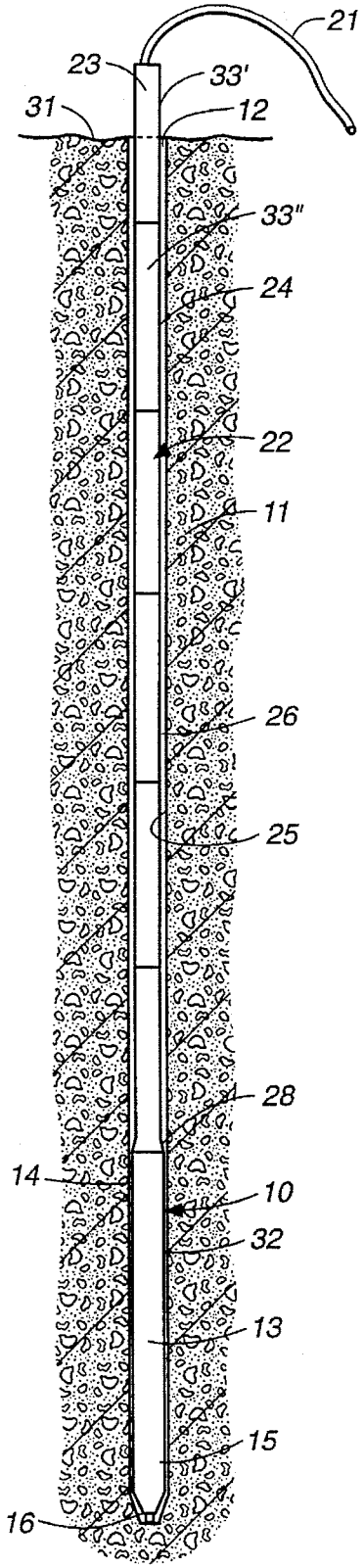
FIG. 2 is a reduced, fragmentary, side elevation view, in cross-section, of the boring tool apparatus and trailing pipe member of FIG. 1.
Figure 3:
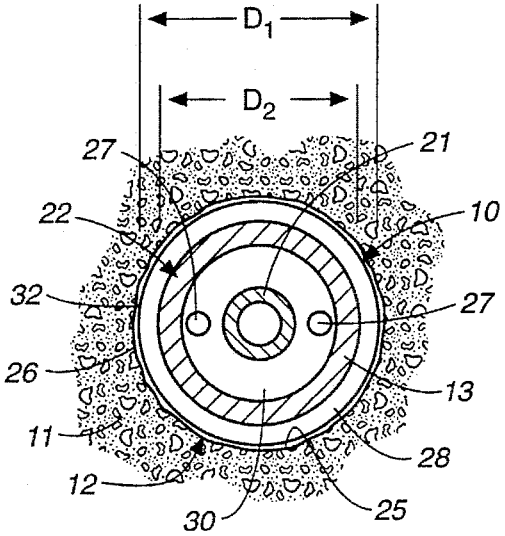
FIG. 3 is a fragmentary, top plane view, in cross-section, of the boring tool apparatus of the present invention taken substantially along the plane of the line 3—3 in FIG. 1.

The present invention, as shown in FIGS. 1–3, provides a self-propelled percussion boring tool apparatus, generally designated 10, and method for incrementally piercing and displacing soil 11 to bore a generally vertical hole 12. Boring tool 10 includes a torpedo-shaped elongated casing 13 having a generally uniform transverse cross-sectional dimension extending from a back end 14 to a front end 15 thereof. The front end terminates at a nose portion 16 which is formed for piercing the soil. A reciprocating hammer member 17 is enclosed in the casing and is formed for reciprocating movement in the direction of arrow 20 and along a longitudinal axis of casing 13. A control line 21 is communicably coupled to hammer 17 for operation thereof, and extends away from back end 14 of the casing. Further, the present invention includes a trailing pipe member, generally designated 22, coupled to or placed behind casing 13 and extending away from back end 14 of the casing in co-axial alignment with the casing longitudinal axis. Trailing pipe 22 is of a length sufficient for grasping of a top or upper end 23 thereof from the ground surface (FIG. 2). FIG. 1 further illustrates that the trailing pipe is formed for receiving the control line therein.

In accordance with the present invention, trailing pipe 22 includes a transverse cross-sectional dimension (diameter $D_2$) smaller than the transverse cross-sectional dimension (diameter $D_1$) of casing 13 such that continuous frictional contact between the perimeter wall 24 of the trailing pipe and the vertical walls 25 forming hole 12 (i.e., above the casing) is avoided (FIG. 3). Further, the transverse cross-sectional dimension of the trailing pipe must be sufficiently large to substantially prevent the buildup of collapsed soil from vertical walls 25 atop a substantial area of the casing back end 14, as shown in FIG. 3. Accordingly, the present invention provides a method and apparatus for employing a percussion boring tool in a vertical hole boring application to depths several times greater than the length of the boring tool while substantially assuring recovery of the boring tool from the hole, and further minimizing the effects of soil collapse from the vertical walls forming the hole.

Briefly, it will be appreciated that boring tool 10 may be provided by any percussion boring tool which includes a reciprocating hammer member or striker. Generally, these boring tools include a reverse mode which enables the boring tool to incrementally "walk" or "climb", self-propelled, out of the hole. In the preferred form, the boring tools are pneumatically operated, such as those described above. Hence, control line 21 is preferably a hose providing compressed air for directional movement of the hammer member. Further, a backup cable or chain (not shown) attached to the casing rear end, or the trailing pipe may be employed to dislodge the tool from the hole when the vertical walls of the hole lack sufficient friction to incrementally back the tool out of the hole.

FIG. 3 best illustrates that the transverse cross-sectional dimension of trailing pipe 22 must be smaller than the transverse cross-sectional dimension of casing 13. The differences between the casing diameter ($D_1$) and the trailing pipe diameter ($D_2$), where both casing 13 and trailing pipe 22 are preferably cylindrical, must be just large enough to avoid continuous frictional contact of the trailing pipe perimeter walls with vertical walls 25 of hole 12, above casing 13, as the boring tool casing itself experiences. Such contact would cause excessive frictional drag longitudinally along the trailing pipe which would necessitate a more powerful boring tool to drive the boring tool to greater depths. Moreover, a more powerful means of removal would be necessitated as well, such as the hoist assembly applied in the GRUNDOMAT® vertical bore machine.

It will be understood that while the figures have been drawn with a small gap between the casing exterior surface 32 and the hole vertical wall 25 for clarity, during actual operation, no such gap exists. As set forth above, the boring tool relies on this frictional contact between the exterior surface and the vertical wall to enable incremental movement of the tool.

The smaller the difference between the two diameters (i.e., $(D_1)-(D_2)$, preferably, having a ratio, $D_2:D_1$, between about 0.95:1 to about 0.7:1.) the less the potential volume of collapsed soil allowed to build-up for retainment in the annular recess 26 (FIGS. 1, 2 and 3) formed between the trailing pipe perimeter wall 24 and the hole vertical wall 25. This is partially due to the fact that the arrangement of the present invention helps reduce soil collapse since the amount of soil which can free fall into the vertical hole is more limited. Hence, the accumulated weight of the collapsed soil in the annular recess is substantially less than it would have been had the trailing pipe been absent. This is especially beneficial since this collapsed soil must still be forced to the sidewalls or plowed out of the hole during removal of the boring tool either by its' own power or through assistance by gripping of the trailing pipe, and/or backup cable or chain.

The trailing pipe can be mounted to back end 14 of casing 13 by a threaded mount or the like. Preferably, the trailing pipe includes a tapered portion 28 (FIG. 1) extending radially outward to smoothly integrate into conformance with the circumference of casing 13.

Because hollow trailing pipe 22 extends all the way to the surface (FIG. 2), the collapsed soil is prevented from falling onto and covering the rear exhaust port 27 of the boring tool so that the maximum power output thereof can be maintained (i.e., by maximizing the breathing efficiency). The elongated passageway 30 formed by trailing pipe 22 not only functions as an exhaust vent for boring tool 10 to exhaust its' fumes, but also is formed to receive and shield hose 21 from vertical walls 25.

As best viewed in FIG. 2, the length of trailing pipe 22 must be sufficient for grasping of at least the trailing pipe top end 23 thereof from the ground surface 31. Hence, should boring tool 10 be incapable of "walking" or "climbing" out of vertical walls 25 under its own power (e.g., where the soil is loose or sandy so that there is insufficient skin friction between the surrounding soil and the exterior surface of casing 13, or where the weight of the collapsed soil substantially impedes recover), the trailing pipe 22 can always be manually or mechanically gripped and pulled upwardly and out of vertical hole 12. Moreover, since the trailing pipe member of the present invention substantially prevents incidental frictional contact with the hole vertical walls 25, the only drag force which must be overcome during recovery is that of the continuous skin frictional contact between the vertical walls 25 of hole 12 and the casing exterior surface 32. This can be compared to the prior art GRUNDOMAT® vertical bore machine which must overcome the additional frictional force between the following pipe and the vertical walls.

In the preferred embodiment, trailing pipe 22 is formed from a plurality of segmented pipes 33 removably mounted to each other in an end-to-end manner. Accordingly, FIG. 2 illustrates that as each segmented trailing pipe 22 is drawn or pulled down vertical hole 12 when boring tool 10 bores vertically deeper, an additional segment 33' is removably mounted to the end of the previous or last segment 33" before it descends beneath the ground surface 31.

The trailing pipes may be joined through threaded mating portions thereof (not shown), slip joints or the like. This arrangement enables use of the present invention at great depths where the application of a non-segmented trailing pipe may be limited or precluded due to the inadequate vertical spacing above the bored hole. Further, it will be appreciated that trailing pipe 22 could be provided by metal, plastic, ceramic, or the like without departing from the true spirit and nature of the present invention.

From the above description of the trailing pipe member embodiment of the present apparatus, it will be understood that the method for boring a generally vertical hole in soil employing a pneumatic, self-propelled boring tool comprises the steps of: (a) selectively driving hammer 17 which causes incremental movement of boring tool 10 into substantially compacted soil 11 which is in direct contact with the tool outer casing 13 to bore a hole defined by compressed walls of the soil 11. The angle of boring should be in the range of about 0° to about 45° from a vertical axis, and more preferably about 0° to about 30°. The next step includes (b) carrying a trailing pipe 22 behind casing 13 into vertical hole 12. The trailing pipe is coupled to or placed behind casing 13 and extends away from the back end 14 thereof in co-axial alignment with the longitudinal axis. Trailing pipe 22 has a transverse cross-sectional dimension smaller than the transverse cross-sectional dimension of casing 13 such that continuous frictional contact with the vertical walls of the hole, above the casing, is avoided. Further, the transverse cross-sectional dimension of trailing pipe 22 must be sufficiently large to substantially prevent soil collapse from vertical walls 25 of hole 12 to a position atop a substantial area of casing 13.

The method of the present invention further includes the step of adding sectional pipe segments 33, a plurality of which are removably mounted end-to-end, to an upper end 23 of trailing pipe 22, during the carrying step. This step must be performed proximate the ground level and before the end is carried into hole 12 by boring tool 10. The method further includes withdrawing tool 10 from hole 12 by grasping trailing pipe end 23 protruding from vertical wall, and pulling upwardly in a direction away from boring tool 10.

Figure 4:
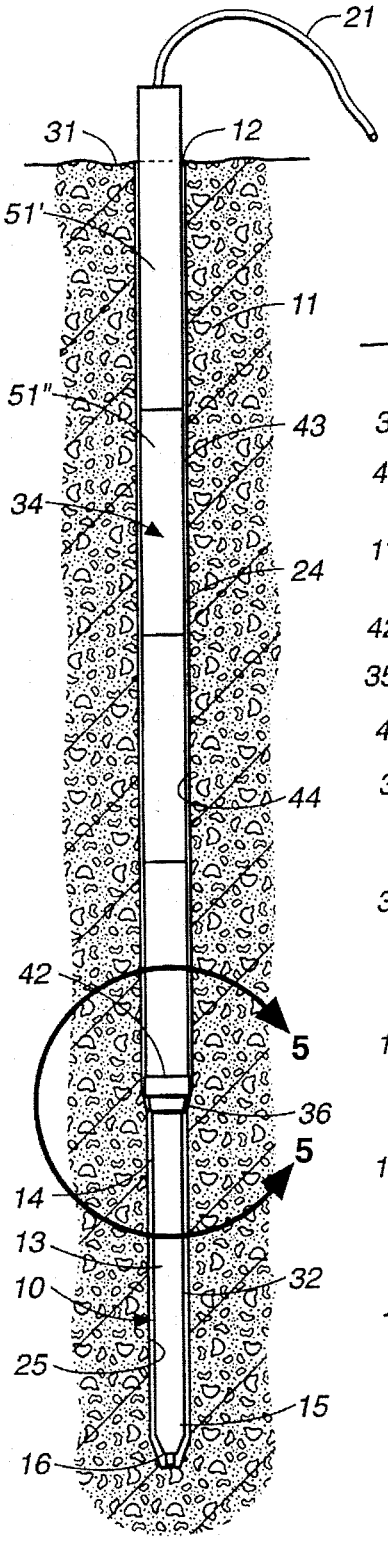
FIG. 4 is a fragmentary, side elevation view, in cross-section, of an alternative embodiment boring tool apparatus of the present invention.
Figure 5:
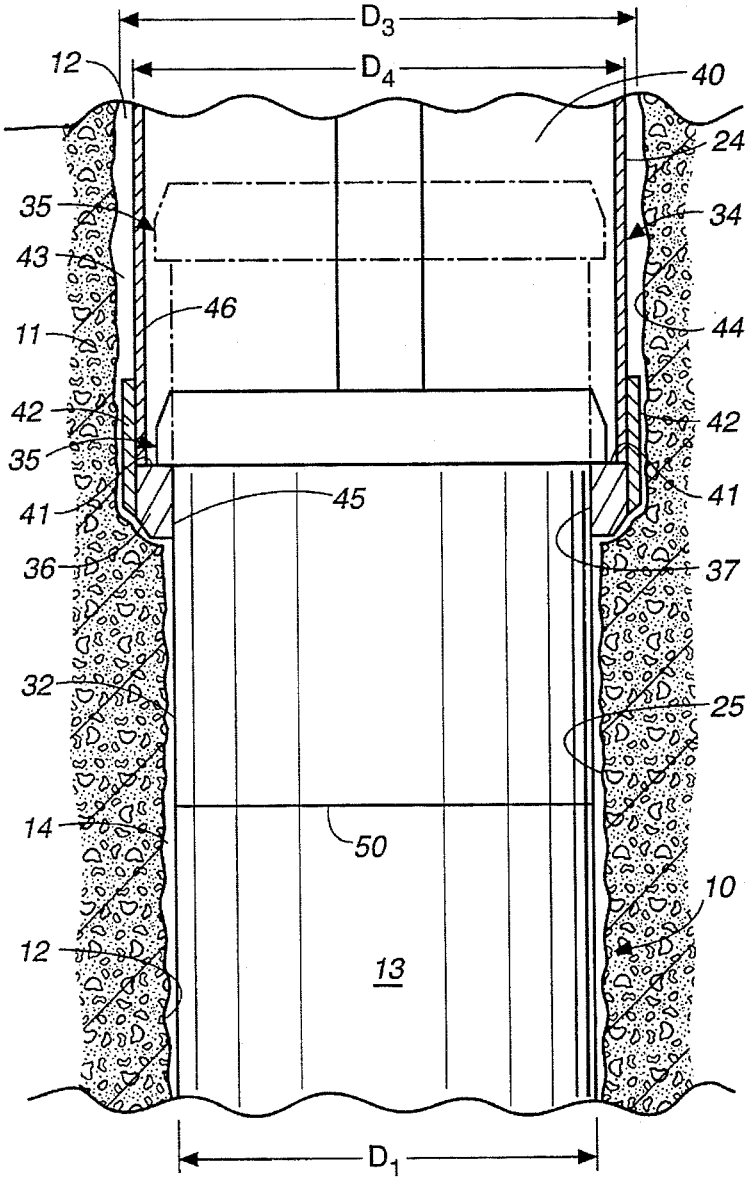
FIG. 5 is an enlarged, fragmentary, side elevation view, in cross-section, of the boring tool apparatus coupled to a trailing pipe of the present invention and taken substantially along the line 5—5 in FIG. 4.

Turning now to FIGS. 4 and 5, another embodiment of the self-propelled percussion boring tool 10 is illustrated which is capable of pulling an elongated trailing pipe member, generally designated 34, vertically into the ground for retainment while enabling recovery of the boring tool from the hole. The boring tool includes a torpedo-shaped elongated casing 13 having an exterior surface 32 defining a generally uniform transverse cross-sectional dimension extending from a back end 14 to a front end 15 thereof. Casing 13 forms a frontwardly facing annular shoulder portion, generally designated 35, extending radially outward from exterior surface 32 proximate casing back end 14. The reciprocating hammer member 17 is enclosed in casing 13 and is formed for reciprocating movement in a direction along a longitudinal axis thereof. An annular ring member, generally designated 36, provides an opening 37 formed and dimensioned for sliding receipt of casing exterior surface 32 therethrough until ring member 36 supportably seats against casing shoulder portion 35. Trailing pipe member 34 is co-axially aligned with casing 13 and is fixedly mounted to ring member 36 in a orientation extending away from casing back end 14. The trailing pipe defines a passageway 40 therethrough sufficient in width for unobstructed receipt of casing exterior surface 32 and annular shoulder portion 35 therein. Ring member 36 cooperates with shoulder portion 35 to urge trailing pipe 34 into vertical hole 12 upon incremental movement of boring tool 10 in a forward direction along the axis into the soil. Further, upon shoulder portion 35 withdrawing from seated contact with ring member 36 during incremental movement of the boring tool in a rearward direction, the boring tool exterior surface 32 moves out of sliding receipt with ring member opening 37. This allows removal of the boring tool through pipe passageway 40 so that trailing pipe 34 can be retained in the hole.

In accordance with this embodiment of the present invention, reinforcement piping or the like can be placed and positioned in deep vertical holes (i.e., several times deeper than the length of boring tool 10) through the use of a percussion boring tool. By mounting trailing pipe to the back end of casing 13, trailing pipe 34 is pulled into vertical hole as boring tool 10 displaces soil to its predetermined depth. Unlike the prior art, however, the boring tool is permitted to utilize its' casing exterior surface 32 to maintain continuous direct contact with the hole vertical walls 25 to maximize the skin friction therebetween. This operation enables the present invention to directly push forward against the vertical walls, while pulling trailing pipe 34 into vertical hole therewith. Further, the present invention assures recovery of boring tool.

The employment of this embodiment is most effective in sandy ground, landfill areas or water infiltrated areas where soil collapse is extremely problematic. Hence, the trailing pipe member of the present invention functions as a "punch pile" or the like which acts to further compress the hole vertical walls. This helps prevent soil collapse by retaining the trailing pipe in the bored hole.

Ring opening 37 is formed and dimensioned for sliding receipt of the exterior surface 32 of boring tool 10 therethrough. As best viewed in FIG. 5, however, ring opening 37 is not dimensioned to permit the passage of shoulder portion therethrough. Accordingly, the boring tool casing will be slidingly positioned through ring opening 37, during installation, until annular shoulder portion 35 seats against an upwardly facing surface 41 of ring member 36.

Once boring tool 10 ascends below the ground surface by frictionally "pushing off" the soil and/or descending due to its own weight in marginal soil material, shoulder portion 35 urges ring member 36 downwardly which drags or pulls trailing pipe 34 into vertical hole 12 therewith (FIG. 4) to substantial depths.

Ring member 36 is either fixedly or removably mounted to trailing pipe 34. In the preferred form, an annular sleeve member 42 extends peripherally around the intersection between ring member 36 and the distal end of trailing pipe 34 (FIG. 5). Annular sleeve member 42 may be welded to ring member 36 and trailing pipe 34, or mounted by any other conventional means, or may be molded or thermoplastically formed as a unitary piece.

Sleeve member 42 is dimensioned to have a transverse cross-section (or diameter ($D_3$) since the trailing pipe, ring member and sleeve member are cylindrical) slightly larger than each the transverse cross-section of ring member 36 and of trailing pipe 34 (i.e., both ($D_4$)). Upon passage of ring member 36 therethrough, vertical hole 12 is further reamed by movement of the sleeve member which causes the formation of a small annular gap 43 (FIG. 5) between the trailing pipe perimeter wall 24 and the vertical walls 44 displaced by the passage of sleeve member 42. This gap 43 enables trailing pipe 34 to slide more easily into vertical hole 12 by reducing frictional drag between the trailing pipe perimeter wall 24 and the vertical walls 44 of hole 12. Accordingly, this small increase in the diameter of vertical hole 12 must be sufficiently large to ease sliding receipt of the trailing pipe therein; while being sufficiently small to retain some frictional contact between the pipe perimeter walls and the vertical walls for retainment in the hole. Further, the increased diameter ($D_3$) of the sleeve member must not be so much larger than that of the boring tool casing so as to substantially impede or prevent movement of the boring tool.

Once the trailing pipe is set or positioned at the predetermined depth, soil collapse from the hole vertical walls, and the settling of the ground will further anchor trailing pipe 34 in vertical hole 12. In some applications, concrete may be poured into a portion of vertical hole, especially in the void left by boring tool 10 at the bottom and/or the gap 43 between the hole vertical wall 44 and the trailing pipe perimeter wall 24, to further anchor trailing pipe 34 in the hole.

In the preferred form, ring member 36 tapers outwardly (FIG. 5) toward sleeve member 42 to facilitate reaming or widening of vertical hole 12 during passage therethrough.

Once boring tool 10 and trailing pipe 34 have reached the desired depth or position, boring tool 10 may be recovered by reversing the striking direction of hammer 17 (FIG. 1). Due in part to the continuous skin frictional contact between the casing exterior surface 32, and the hole vertical walls 25, as well as the interior wall 45 forming ring opening 37, boring tool 10 will begin to incrementally climb out of ring member opening 37 (shown in phantom lines in FIG. 5). In turn, this causes annular shoulder portion 35 to unseat from contact with the upwardly facing surface 41 of ring member 36.

The boring tool may further be removed from ring member opening 37 by a backup chain or cable or other mechanical means mounted to the casing rear end 14 or a second trailing pipe (not shown), similar to the previous embodiment, should the skin friction between the vertical wall 25 and the casing exterior surface 32 be insufficient, and/or the combined weight of the tool and/or second trailing pipe be too great to reverse the tool from ring member.

As nose portion 16 reversibly enters ring opening 37, casing exterior surface 32 will be moved out of frictional contact with ring member 36 so that boring tool 10 can be pulled out of passageway 40 of trailing pipe 34 for recovery. Therefore, in accordance with the present invention, the inner wall 46 forming passageway 40 must be sufficient in diameter to permit passage of both the shoulder portion and the boring tool casing 13 therethrough in an unobstructed manner. That is, the tolerance between the diameter of shoulder portion 35 and of the inner wall 46 of trailing pipe 34 must be sufficient to prevent continuous frictional contact therebetween during withdrawal through passageway 40.

Shoulder portion 35 is preferably integrally formed with a tail piece member 50 removably mounted to the back end 14 of casing 13. Tail piece member 50 could be threadably mounted to casing 13, or may be removably mounted by other conventional means.

Trailing pipe member could also be slotted or perforated therealong for use in horizontal and/or drainage applications. Further, the trailing pipe could be composed of metal, plastic, ceramic, or the like. As best viewed in FIG. 4, trailing pipe member 34 is preferably formed from a plurality of segmented pipes 51 either removably mounted or permanently affixed to each other in an end-to-end manner. Similar to the previous embodiment, each segmented trailing pipe 34 is drawn down vertical hole 12 as boring tool 10 bores vertically deeper. As the last segment 51" descends beneath the ground surface 31, an additional segment 51' is removably mounted to the end of the previous segment 51". The trailing pipes may be joined through threaded mating portions thereof (not shown) or other means such as gluing or welding, etc. Again, this arrangement enables use of the present invention to great depths where the application of a non-segmented trailing pipe may limited or precluded due to the inadequate vertical spacing or headroom above the bored hole.

Figure 6:
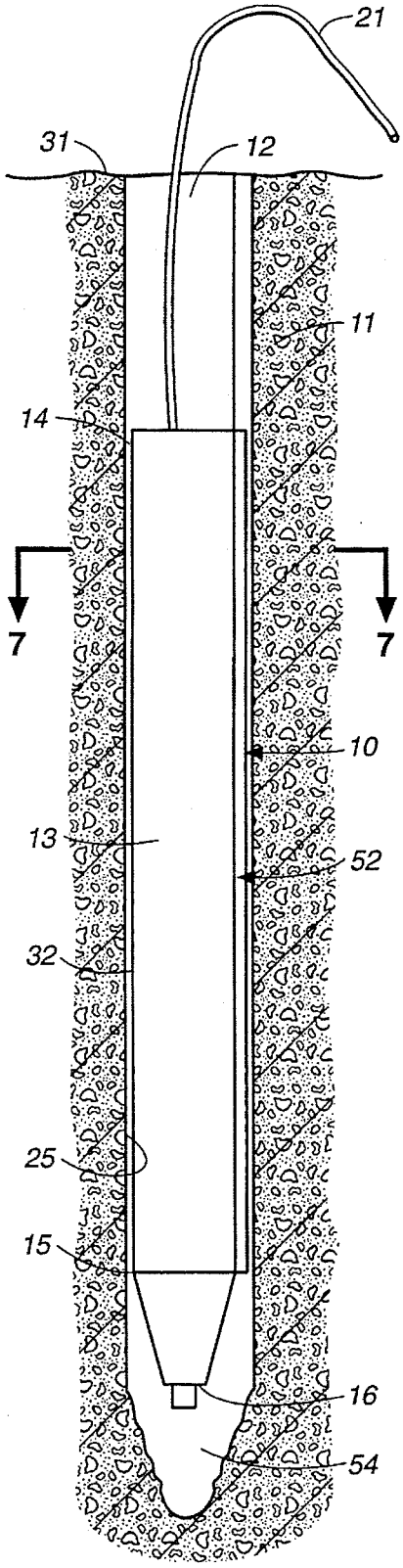
FIG. 6 is a fragmentary, side elevation view, in cross-section, of another alternative embodiment percussion ground boring tool of the present invention including a anti-vacuum tube.
Figure 7:
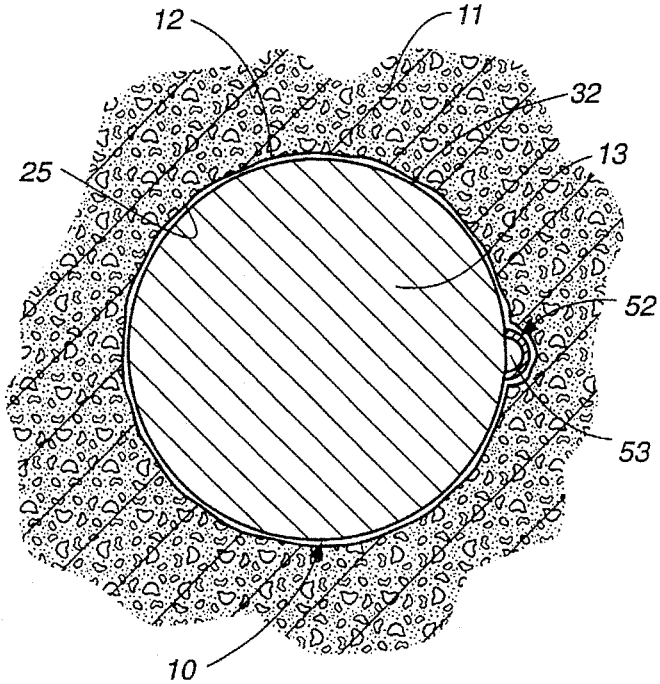
FIG. 7 is an enlarged, fragmentary, top plan view, in cross-section, of the alternative boring tool apparatus embodiment taken substantially along the plane of the line 7—7 in FIG. 6.

In another alternative embodiment of the present invention, as shown in FIGS. 6 and 7, boring tool 10 includes an elongated anti-vacuum air tube, generally designated 52, extending longitudinally along the exterior surface 32 of casing 13 from proximate front end 15 to back end 14 thereof. Air tube 52 provides an air communication passage (i.e., channel 53) between the front end of the casing and the back end thereof so that upon reversal of boring tool from vertical hole 12, a vacuum will not form in the expanding cavity 54 (FIG. 6) created between the casing nose portion 16 and the compacted soil as the boring tool is backed out of the hole. This negative pressure may substantially impede reverse movement of the boring tool during recovery. This is especially apparent in water saturated soil conditions which tend to form "tight seals" around the boring tool casings.

Air tube 52 provides a longitudinal channel 53 which can be of a small transverse cross-sectional dimension relative the diameter of casing 13 (FIG. 7). Hence, tube 52 may be fully or partially integrated into the exterior surface 32 of casing 13 so as not to cause any substantial protuberance which may hinder proper boring of boring tool 10.

What is claimed is:

1. A self-propelled boring tool for incrementally piercing soil to form holes having generally compacted walls, said tool comprising:

a torpedo-shaped elongated casing having a generally uniform transverse cross-sectional dimension extending from a back end to a front end thereof, said front end terminating at a nose portion formed for piercing the soil;

a reciprocating hammer member enclosed in said casing and formed for reciprocating movement along a longitudinal axis of said casing; and an elongated anti-vacuum air tube extending longitudinally from proximate said front end to said back end, said air tube providing air communication between a cavity proximate the front end and the back end of said casing, said cavity being formed between the casing nose portion and the compacted soil walls caused as said nose portion is backed out of the hole.

2. The boring tool as defined in claim 1 wherein, the casing is cylindrically-shaped.

3. The boring tool as defined in claim 2 wherein, the diameter of said casing is substantially larger than the diameter of said air tube.

4. A self-propelled boring tool for incrementally piercing soil to form generally vertical holes comprising:

a torpedo-shaped elongated casing having an exterior surface defining a generally uniform transverse cross-sectional dimension extending from a back end to a front end thereof, said front end terminating at a nose portion formed for piercing the soil, said casing including a forwardly facing annular shoulder portion extending radially outward from said exterior surface proximate the casing back end;

a reciprocating hammer member enclosed in said casing and formed for reciprocating movement in a direction along a longitudinal axis of said casing;

an annular ring member defining an opening formed and dimensioned for sliding receipt of the casing exterior surface therethrough until said ring member supportably seats against the casing shoulder portion; and an elongated trailing pipe member co-axially aligned with said casing and fixedly mounted to said ring member in an orientation extending away from the casing back end, said pipe member defining a passageway therethrough sufficient in transverse cross-sectional dimension for unobstructed receipt of the transverse cross-sectional dimension of the casing exterior surface and the casing annular shoulder portion therein;

said ring member cooperating with said shoulder portion to urge said trailing pipe into the vertical hole upon incremental movement of said boring tool in a forward direction along said axis into the soil, and said shoulder portion withdrawing from seated contact with said ring member upon incremental movement of said boring tool in a rearward direction along said axis out of said hole, the boring tool exterior surface further moving out of sliding receipt of with the ring member opening for removal of said boring tool through the pipe passageway wherein said trailing pipe is retained in said hole.

5. The boring tool as defined in claim 4 wherein, said ring member tapers outwardly toward said trailing pipe member.

6. The boring tool as defined in claim 4 wherein, said ring member is integrally formed with said trailing pipe member.

7. The boring tool as defined in claim 4 further including:

a tail piece member providing said annular shoulder portion, and removably mounted to said casing back end.

8. The boring tool as defined in claim 4 wherein, the casing and the pipe member are cylindrical-shaped.

9. The boring tool as defined in claim 4 wherein, said pipe member is comprised of a plurality of sectional pipe segments removably mounted end-to-end.

10. The boring tool as defined in claim 4 further including:

an annular sleeve member mounted to one of said ring member and said pipe member proximate said ring member, said sleeve member having a transverse cross-sectional dimension slightly larger than the transverse cross-sectional dimension of said ring member and said pipe member to ream said vertical hole during passage of said ring member therethrough.

11. A method of boring a generally vertical hole in soil employing a pneumatic, self-propelled boring tool including a reciprocating hammer slidably enclosed in a torpedo-shaped outer casing, the casing having a generally uniform transverse cross-sectional dimension extending from a back end to a front end thereof, and terminating at a nose portion, said method comprising the steps of:

(a) selectively driving said hammer causing incremental movement of said boring tool into substantially compacted soil in direct contact with said tool outer casing, at an angle in the range of about 0° to about 45° from a vertical axis, to bore a hole defined by compressed walls of said soil;

(b) carrying a trailing pipe member coupled to said casing into said hole, said pipe member being comprised of a plurality of sectional pipe segments removably mounted end-to-end and extending away from the back end of said casing in co-axial alignment with the longitudinal axis thereof, said pipe member being of a length sufficient for grasping of an end thereof from the ground surface and having a transverse cross-sectional dimension smaller than the transverse cross-sectional dimension of said casing such that continuous frictional contact with the vertical walls of the hole above said casing is avoided, the pipe member further having a transverse cross-sectional dimension sufficiently large to substantially prevent soil collapse from vertical walls of said hole to a position atop a substantial area of said casing;

adding said sectional pipe segments to an end of said pipe member proximate the ground level before said end is carried into said hole;

withdrawing said tool from said hole by grasping the end of said pipe member protruding from said vertical wall; and pulling upwardly in a direction away from said boring tool.

* * * * *